US009376934B2

(12) United States Patent
Cooper et al.

(10) Patent No.: US 9,376,934 B2
(45) Date of Patent: Jun. 28, 2016

(54) COOLING CIRCUIT FOR REDUCING THERMAL GROWTH DIFFERENTIAL OF TURBINE ROTOR AND SHELL SUPPORTS

(75) Inventors: Edward Jay Cooper, Niskayuna, NY (US); Peter John Eizenzopf, Altamont, NY (US); Xiaoqing Zheng, Niskayuna, NY (US); William Patrick Rusch, Amsterdam, NY (US); Hemanth GS Kumar, Bangalore (IN); Craig Daniel Ivancic, Gloversville, NY (US); Edward John Sharrow, Glenville, NY (US)

(73) Assignee: General Electric Company, Schenectady, NY (US)

( * ) Notice: Subject to any disclaimer, the term of this patent is extended or adjusted under 35 U.S.C. 154(b) by 979 days.

(21) Appl. No.: 13/594,609

(22) Filed: Aug. 24, 2012

(65) Prior Publication Data

US 2014/0053394 A1 Feb. 27, 2014

(51) Int. Cl.

| | |
|---|---|
| ***F01D 25/12*** | (2006.01) |
| ***F01D 25/14*** | (2006.01) |
| ***F01D 25/16*** | (2006.01) |
| ***F01D 25/24*** | (2006.01) |

(52) U.S. Cl.

CPC ..... *F01D 25/12* (2013.01); *F01D 25/14* (2013.01); *F01D 25/16* (2013.01); *F01D 25/24* (2013.01); *F05D 2220/31* (2013.01); *Y10T 29/53113* (2015.01)

(58) Field of Classification Search

CPC ..... F01D 25/08; F01D 25/14; F01D 25/145
USPC ..... 415/180; 29/726
See application file for complete search history.

(56) References Cited

U.S. PATENT DOCUMENTS

| | | | |
|---|---|---|---|
| 3,881,843 | A | 5/1975 | Meylan |
| 4,076,452 | A | 2/1978 | Hartmann |
| 6,325,596 | B1 | 12/2001 | Tomko |
| 6,352,405 | B1 | 3/2002 | Tomko |
| 7,237,958 | B2 | 7/2007 | Giberson |
| 7,458,770 | B2 | 12/2008 | Russo et al. |

(Continued)

FOREIGN PATENT DOCUMENTS

| | | | |
|---|---|---|---|
| CN | 101230800 | A | 7/2008 |
| CN | 101321929 | A | 12/2008 |

(Continued)

OTHER PUBLICATIONS

Unofficial English Translation of Chinese Office Action issued in connection with corresponding CN Application No. 201310371675.2 on Sep. 29, 2015.

*Primary Examiner* — Craig Kim
*Assistant Examiner* — Michael Sehn
(74) *Attorney, Agent, or Firm* — Nixon & Vanderhye P.C.

(57) ABSTRACT

A standard for supporting a turbine rotor and a turbine shell includes a bearing block including a housing enclosing bearing surfaces engageable by the turbine rotor. Turbine shell-arm supports are located on opposite sides of the housing, the turbine shell-arm supports each having a horizontal and one or more vertical surfaces adapted to be engaged by support arms of a turbine shell enclosing at least a portion of the turbine. An internal cooling/heating circuit is arranged to simultaneously cool or heat the bearing block and the turbine shell-arm supports to thereby reduce differential thermal growth characteristics of the turbine rotor and turbine shell.

20 Claims, 7 Drawing Sheets

(56) References Cited

U.S. PATENT DOCUMENTS

| | | | | |
|---|---|---|---|---|
| 7,686,569 | B2 | 3/2010 | Paprotna et al. | |
| 8,083,471 | B2 | 12/2011 | Black et al. | |
| 8,192,151 | B2 | 6/2012 | Ballard | |
| 8,550,773 | B2 | 10/2013 | Almstedt et al. | |
| 2010/0329837 | A1* | 12/2010 | Cooper | F01D 25/28 415/1 |
| 2011/0008158 | A1* | 1/2011 | Boening | F01D 25/24 415/200 |
| 2011/0142605 | A1 | 6/2011 | Koza et al. | |

FOREIGN PATENT DOCUMENTS

| | | | |
|---|---|---|---|
| CN | 101876261 | A | 11/2010 |
| EP | 1255024 | A2 | 11/2002 |

* cited by examiner

COOLING CIRCUIT FOR REDUCING THERMAL GROWTH DIFFERENTIAL OF TURBINE ROTOR AND SHELL SUPPORTS

BACKGROUND OF THE INVENTION

The present invention relates generally to turbine plant construction, and more specifically, to a support arrangement that achieves more uniform thermal growth of the turbine rotor and the turbine shell thereby enabling reduced clearance at the rotor/shell interface.

In some current steam turbine designs, clearance closure at the "pinch point" between the rotor and the turbine shell may be on the order of 0.010 inch during turbine operation due to the difference in vertical growth of the rotor bearing supports (or bearing blocks) and the turbine shell-arm supports during turbine operation. Rotor vertical fall and rise, due to thermal growth and contraction of the bearing block is relatively fast (less than an hour), while shell-arm vertical rise and fall due to thermal growth and contraction of the shell support structure is relatively slow (about 16 hours to achieve full growth). In this regard, assumptions that rotor growth and shell growth at turbine standards are substantially equal because lubricant temperatures drive both growths have been proven to be incorrect.

Every mil of clearance between the turbine rotor structure and the turbine shell causes significant leakage loss, and resulting performance and monetary losses. While there have been attempts to achieve more uniform thermal growth characteristics as between the rotor and the shell to reduce leakage loss, such attempts have fallen short of desired goals.

BRIEF SUMMARY OF THE INVENTION

In accordance with an exemplary but nonlimiting embodiment, there is provided a standard for supporting a turbine rotor and a turbine shell comprising a bearing block including a housing enclosing arcuate bearing surfaces engageable by the turbine rotor; turbine shell-arm supports on opposite sides of the housing, the turbine shell-arm supports each having a horizontal and one or more vertical surfaces adapted to be engaged by support arms of a turbine shell enclosing at least a portion of the turbine; and a cooling/heating circuit utilizing a heat exchanger medium arranged to simultaneously cool or heat the bearing block and the turbine shell-arm supports to thereby reduce differential thermal growth characteristics of the turbine rotor and turbine shell.

In another aspect, there is provided a standard for supporting a turbine rotor and a turbine shell comprising a bearing block including a housing enclosing arcuate bearing surfaces engageable by the turbine rotor; turbine shell-arm supports on opposite sides of the housing, the turbine shell-arm supports each having a horizontal and one or more vertical surfaces adapted to be engaged by support arms of a turbine shell enclosing at least a portion of the turbine; a cooling/heating circuit arranged to supply a liquid to simultaneously cool or heat the bearing block and the turbine shell-arm support blocks to thereby reduce differential thermal growth characteristics of the turbine rotor and turbine shell; and wherein the at least two branch lines connect to an internal circuit in each of the shell-arm supports, the internal circuit arranged to cool or heat the horizontal and the one or more vertical surfaces.

The invention will now be described in detail in connection with the drawings identified below.

DETAILED DESCRIPTION OF THE INVENTION

Figure 1:
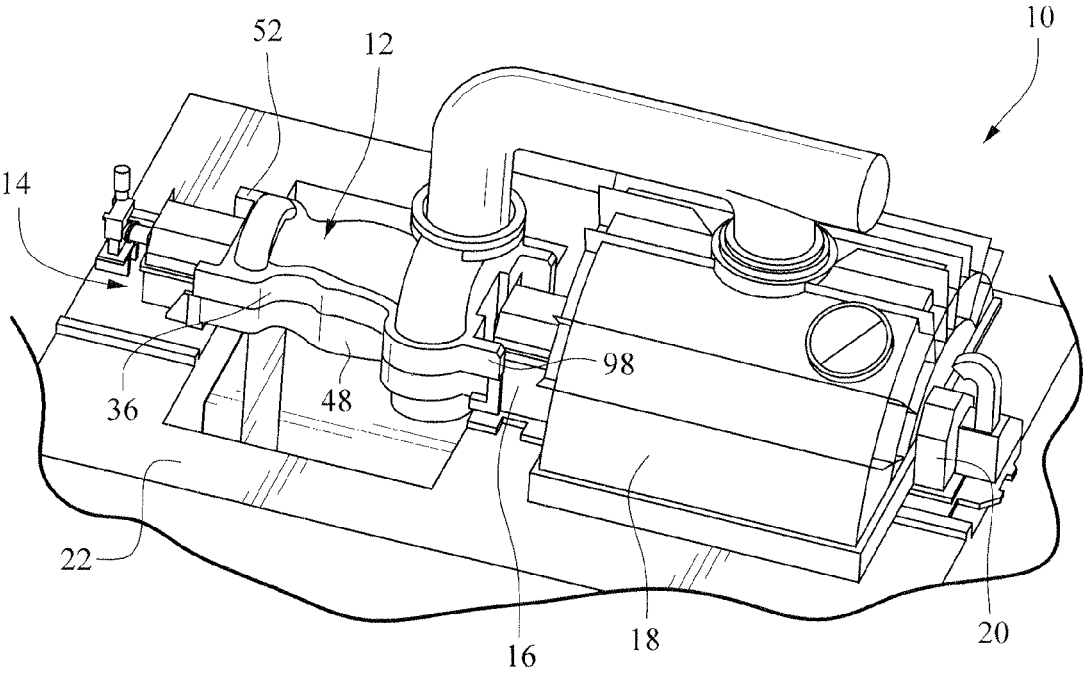
FIG. 1 is a partial perspective view of a conventional low/intermediate high pressure turbine configuration.

With reference initially to FIG. 1, a turbine plant 10 is partially shown, indicating among other components a high-pressure (HP)/intermediate-pressure (IP) turbine shell or casing 12 and a front rotor and shell support standard 14. The standard 14 supports one end of the turbine rotor and a pair of support arms forming part of the outer turbine shell. An LPA or mid-standard 16 is located axially between the HP/IP shell 12 and the upper, low-pressure (LP) exhaust hood 18, and a third standard 20 is shown at the opposite end of the exhaust hood 18. In this known arrangement, the standards 14, 16 and 18 are typically supported on a concrete foundation 22, and serve as bearing blocks for the turbine rotor R which extends axially through the HP/IP shell and exhaust hood, and supports for the turbine shell 12. It will be appreciated that one or more additional standards may be utilized to support the turbine rotor/shell in any given turbine plant, and the invention here is not limited to the turbine configuration described and illustrated herein. In addition, for purposes of this invention, various other details of the turbine compressor, combustors and turbine stages need not be described in detail. The disclosure here concerns the construction of the one more of the standards which support the turbine rotor and the turbine shell or casing.

Figure 2:
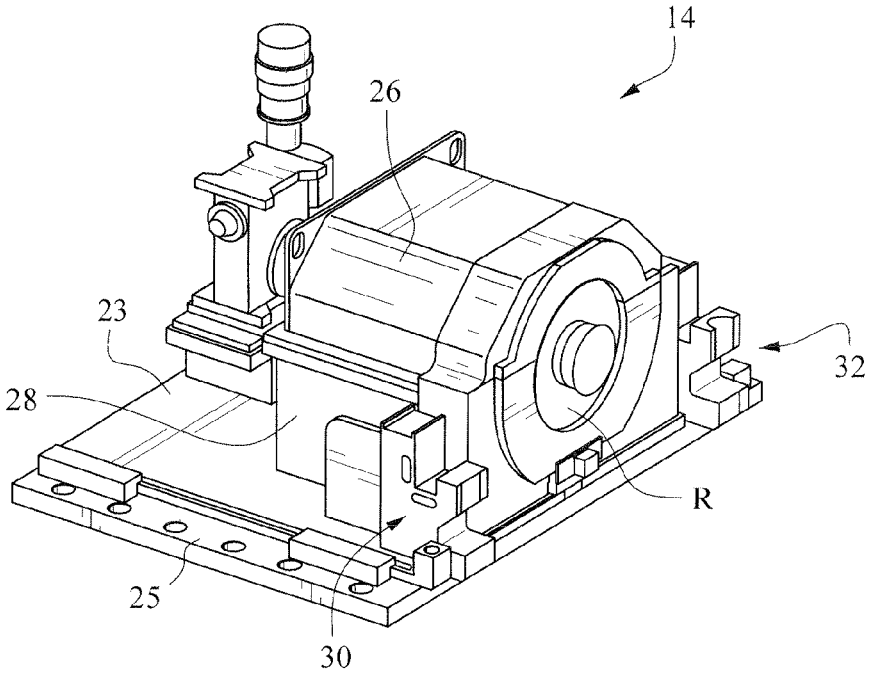
FIG. 2 is a perspective view of a front standard incorporating a rotor bearing block and shell-arm support structure for the turbine shown in FIG. 1.

FIG. 2 illustrates the front standard 14 in more detail. Specifically, the front standard 14 includes an upper half cap portion 26 and a lower half portion 28 incorporating one or two otherwise conventional journal bearings and in some cases, a thrust bearing. The rotor R is shown centered within and enclosed by the bearing block 24 (see FIG. 5). The standard 14 also includes shell-arm support blocks 30 and 32 on opposite sides of the bearing block 24 which receive the upper and lower portions of the HP/IP shell 12 (FIG. 1) as explained further below in connection with FIGS. 3 and 4. Since the shell-arm support blocks 30 and 32 are mirror images of each other, only the shell-arm support block 30 will be described in detail. Each support block 30 and 32 is fixed to the lower half portion 28 of the standard 14.

Figure 3:
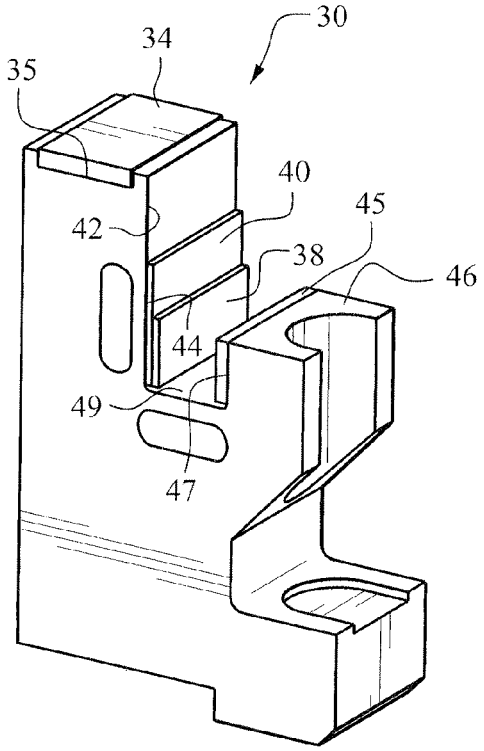
FIG. 3 is a shell-arm support block isolated from FIG. 2.
Figure 4:
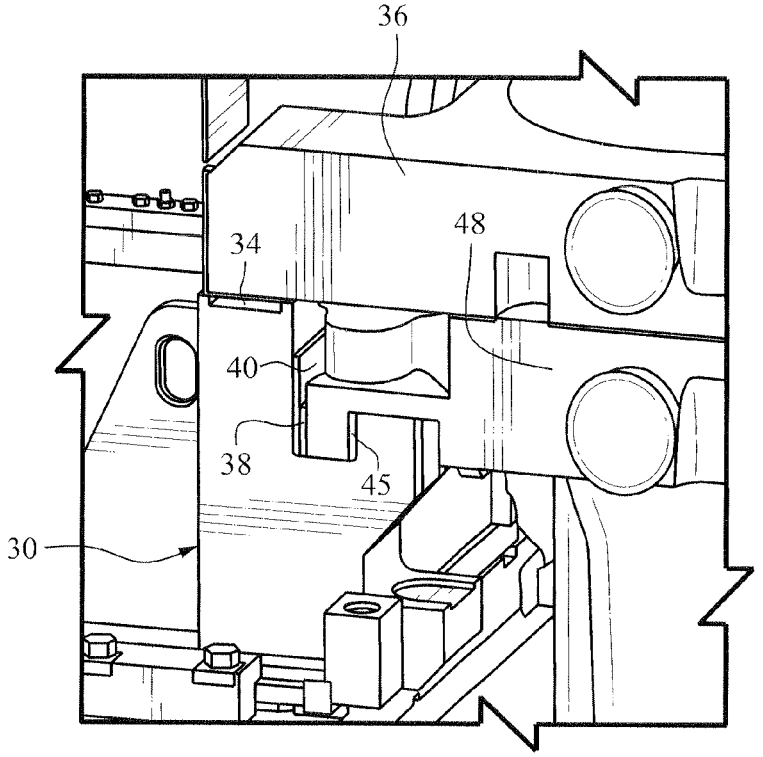
FIG. 4 is a partial perspective view illustrating the manner in which upper and lower shell arms are seated on the shell-arm support block of FIG. 3.

With specific reference to FIG. 3, the shell-arm support block 30 includes a horizontally-oriented, vertical-load key or pad 34 supported on an underlying first horizontal support surface 35, adapted to receive an upper shell arm 36 as best seen in FIG. 4. At the same time, axial-load keys or pads 38, 45 are supported on respective vertically-oriented support block surfaces 40 and 47, adjacent a second horizontal surface 46. Thus, vertical surfaces 40, 47 are separated by a horizontal surface 49. Again, and as best seen in FIG. 4, the end portion of the lower shell arm 48 is hook-shaped, and is suspended from the bolted joint of the upper shell arm 36. Note that there is space to permit some axial movement (normally just a few thousandths of an inch) toward or away from the axial-load keys 38 and 45. This same arrangement is repeated on the opposite side of the standard 14 in the shell-arm support block 32 which supports the upper shell arm 52 (FIGS. 1 and 4) and associated lower shell arm 48 (FIGS. 1 and 4).

Figure 5:
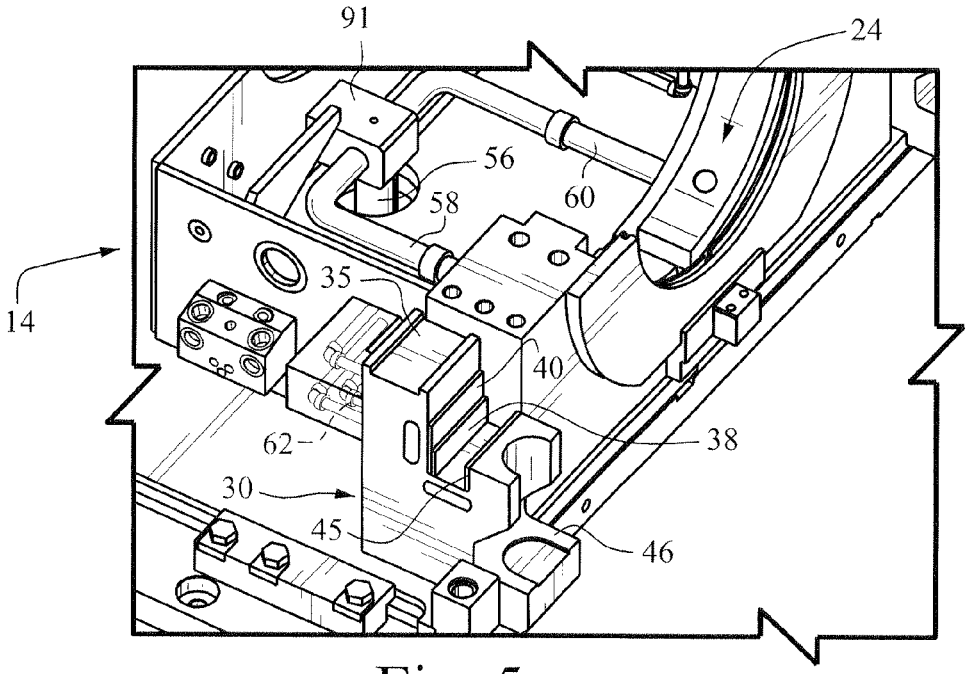
FIG. 5 is a partial perspective view of the standard shown in FIG. 2 but with the upper bearing portion removed to illustrate part of the internal cooling circuit to the standard.
Figure 6:
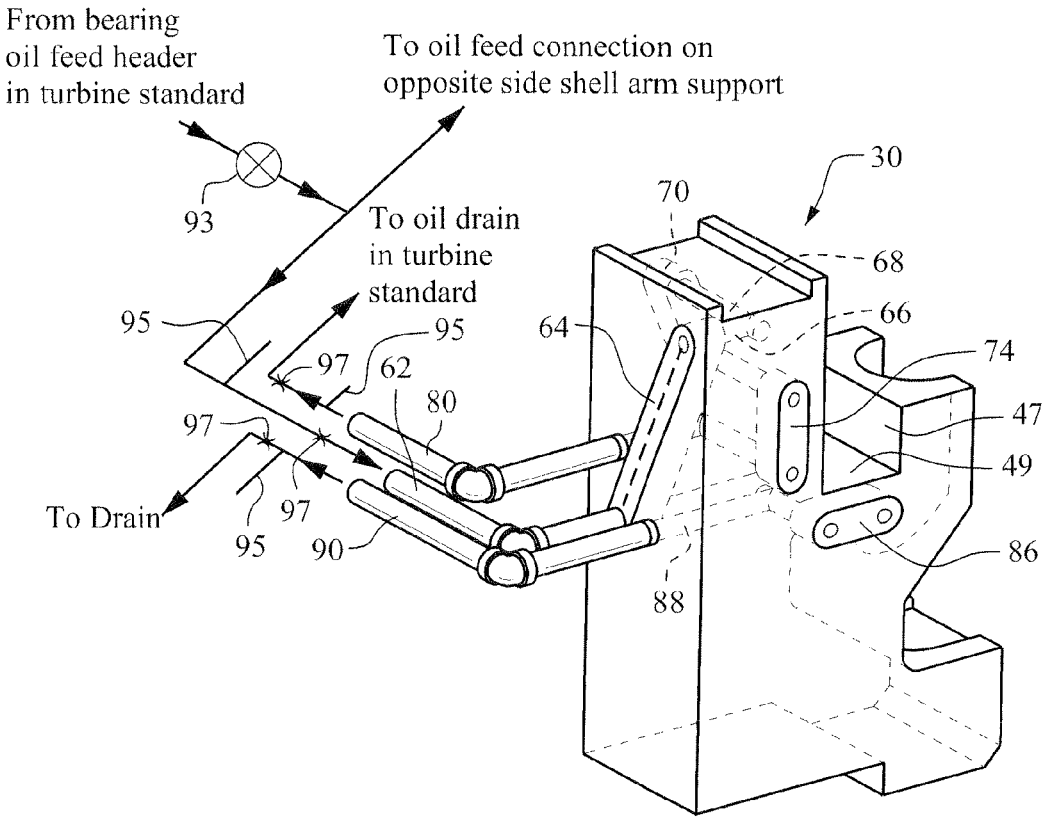
FIG. 6 is a partial perspective view illustrating the shell-arm support block of FIG. 3 and incorporating a cooling circuit in accordance with an exemplary but nonlimiting embodiment.
Figure 7:
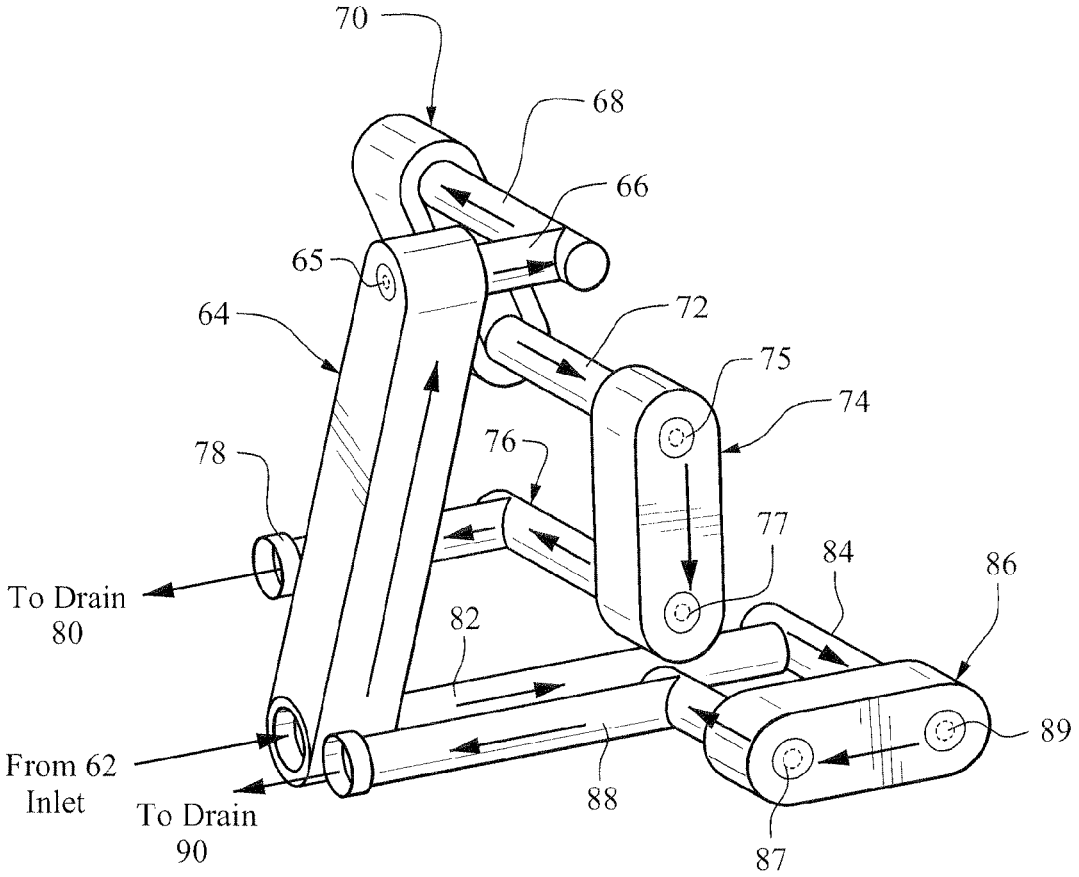
FIG. 7 is a perspective view of the cooling circuit isolated from the block shown in FIG. 6.

FIGS. 5-7 illustrate the manner in which the shell-arm support blocks 30, 32 are cooled in one exemplary but non-limiting embodiment, utilizing the same cooling oil supplied to the bearing block 24. Since the cooling circuits for blocks 30, 32 are substantially identical, only the circuit associated with block 30 will be described in detail. For convenience, the cooling circuit described in connection with FIGS. 5 and 6 is shown more clearly in FIG. 7 where it is isolated from the shell-arm support structure.

Pressurized lubrication oil is supplied to the front standard 14 and bearing block 24 by means of a lubricant supply pipe 56 (FIG. 5) which divides into two branch lines 58, 60 that feed oil to the bearing block 24. Within the front standard 14, a predetermined fraction of the inlet oil is diverted into each of the shell-arm support blocks 30, 32. As noted above, emphasis here is on the shell-arm support 30. As best seen in FIG. 6, the diverted inlet oil is supplied to the shell-arm support block 30 and internal passages are formed within the block to flow the oil through internal passages adjacent, for example, the vertical-load key 34 and the axial-load keys 38, 45. Specifically, the oil is supplied to the shell-arm support block 30 via an inlet pipe 62 and enters an angled passage 64 in the form of a grooved plug which, in turn, supplies the oil along and beneath the vertical-load key support surface 35 via passages 66, 68. The oil then flows through a second, angled, grooved plug 70 to a lower-lateral passage 72 (FIG. 7). The oil then enters a third, substantially vertically-oriented, grooved plug 74 connected substantially to another horizontal passage 76 and then exits the shell-arm support block 30 via pipe 78 which, in turn, connects to a drain pipe 80. Note that the passages 72, 76 extend along and adjacent the vertically-oriented support block surfaces 42, 44 to cool those surfaces and the respective keys or pads 38, 45.

Oil from the inlet pipe 62 also flows through the lower end of the angled, grooved plug 64 into a second circuit via pipe 82 which follows a closed path through the lateral passage 84, horizontally-oriented grooved plug 86, and lateral passage 88 leading to another drainage pipe 90. The passage 84 and grooved plug 86 thus direct the oil along and directly under the horizontal surface 49.

From the above description, it will be apparent that the lubricant oil used to directly cool critical surfaces of the shell-arm support blocks including the key or pad 34 and underlying surface 42, as well as the keys or pads 38, 45 and underlying surfaces 42, 44 and horizontal surface 49; and indirectly cool key or pad 45 and underlying surface 47. In this way, the bearing block 24 and shell-arm support blocks 30, 32 are maintained at more relatively uniform temperatures, thus leading to more uniform thermal growth characteristics of both components.

Figure 9:
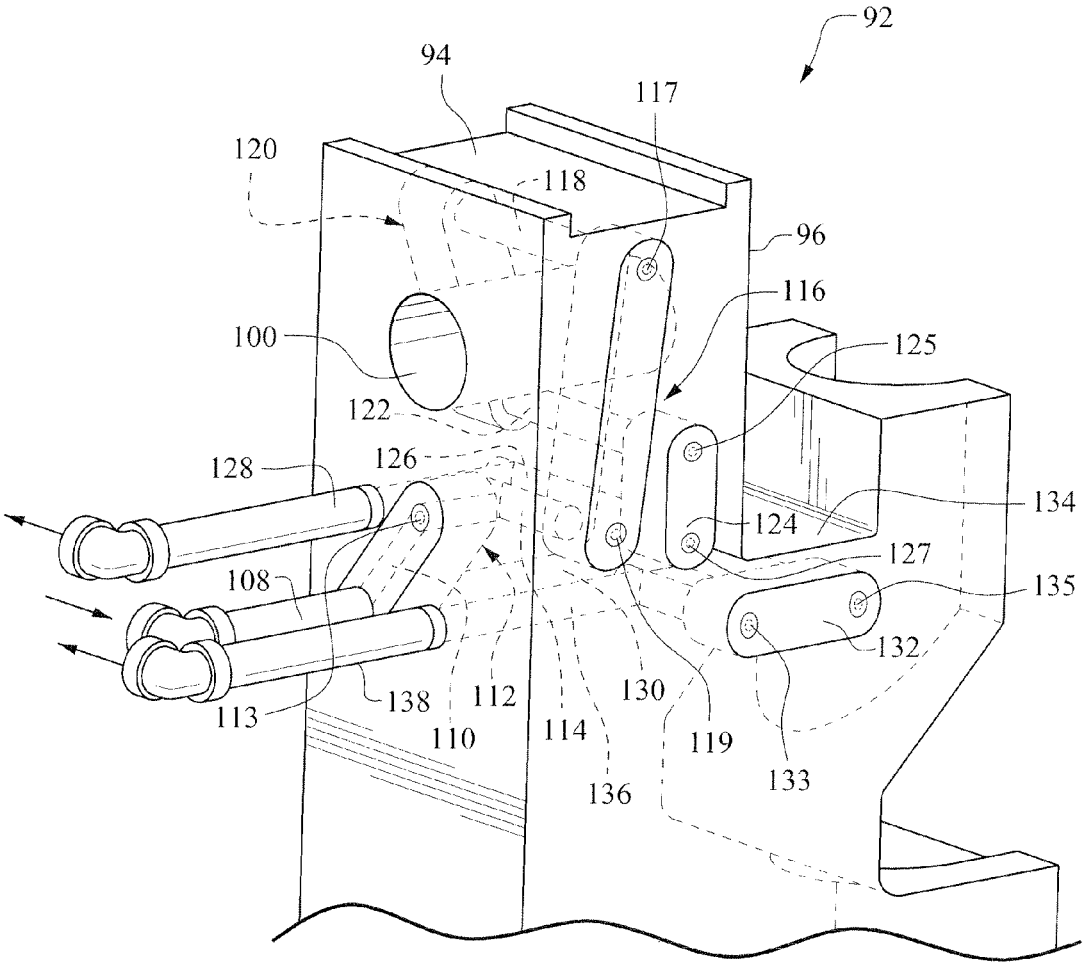
FIG. 9 is perspective view of the shell-arm support block incorporating a cooling circuit and in accordance with the exemplary but nonlimiting embodiment.

In the exemplary but nonlimiting embodiment, the drain is split into the two lines 80, 90 in order to minimize the length of individual drains in the shell-arm support block. Manufacturing efficiencies are also realized by the use of grooved plugs 64, 70, 74 and 86 which minimize drilling, particularly in otherwise hard-to-reach locations within the support block. The grooved plugs are simply blocks formed with inwardly-facing grooves that form passages when inserted into recesses in the support blocks. Drilling inlets and outlets in the plug to access the groove, rather than drilling hard-to-reach areas of the support block itself, greatly simplifies the manufacture of the support blocks. The grooved plugs 64, 70, 74 and 86 are seal welded onto the shell support blocks 30 and 32 to prevent external leakage as the pressurized oil flows along the internal passageways. Use of these plugs not only serves to minimize the number of drilled holes within the support blocks 30 and 32, but also maintains strength and allows the blocks to adequately support the heavy turbine shell loads. As shown in FIGS. 7 and 9, pipe plugs 65, 75, 77, 87, and 113, 117, 119, 133 and 135, respectively 89 are installed in most of the seal welded grooved plug pieces. These pipe plugs line up with the connecting horizontal oil passageways to provide access to the passageways during maintenance outages to allow visual and boroscope inspection and clean up of any debris that may have accumulated during many months of turbine operation.

In this exemplary embodiment, the feed line 62 may be a pipe of approximately one-inch diameter carrying a flow rate much smaller than the required flow to the turbine journal bearing within the standard, 14. The pressurized bearing header oil is initially taken out of the bearing feed oil manifold block 91, inside the turbine standard 14, as shown in FIG. 5. The shell support block oil cooling flow is then piped to a manual shutoff valve, 93, mounted on the side wall of the turbine standard 14, as depicted in FIG. 6. This valve is normally left wide open for normal turbine operation. The oil flow downstream of this shutoff valve is then split up to go separately to each shell arm support block, 30 and 32. For example, one branch line would connect to one of the shell support blocks via inlet feed pipe, 62, as shown in FIG. 6. The shutoff valve 93 serves as a safety device in the highly unusual case of external oil leakage coming from the oil-cooled shell support blocks, 30 and 32, or from the piping connecting to these blocks, 62, 80 and 90. Note that each feed and drain pipe connecting to the shell support blocks, 30 and 32, is equipped with a monitoring thermocouple 95, as well as an orifice 97, to control the feed or exiting drain flow. The orifice 97 in each of the two drain lines 80 and 90 serves to ensure that the oil passageways within each shell support block 30 and 32 will remain full of oil (pressurized) to maximize the heat absorption of the flow. In addition, the drain line orifice sizes can be varied to better control temperature and heat absorption in the two separate heat input regions of each shell arm support 30 and 32, to further optimize the overall cooling circuit. The orifice 97 in the feed line 62 controls the overall flow rate into the shell arm blocks 30 and 32. This flow rate is designed to be high enough to sufficiently cool the support blocks, 30 and 32, but not excessively high to be wasteful of the turbine bearing header overall flow capacity. The thermocouples 95, allow remote monitoring of the oil temperature coming into and out of each shell arm support block 30 and 32. We expect some temperature increase of the drain oil relative to the cooled bearing feed oil, as heat is picked up by the oil within the shell support blocks 30 and 32. Very small differences in feed and drain temperatures coming out of the oil-cooled blocks may indicate insufficient flow rates through the feed orifice 97, or a potential blockage within the oil passageways of the blocks.

Figure 8:
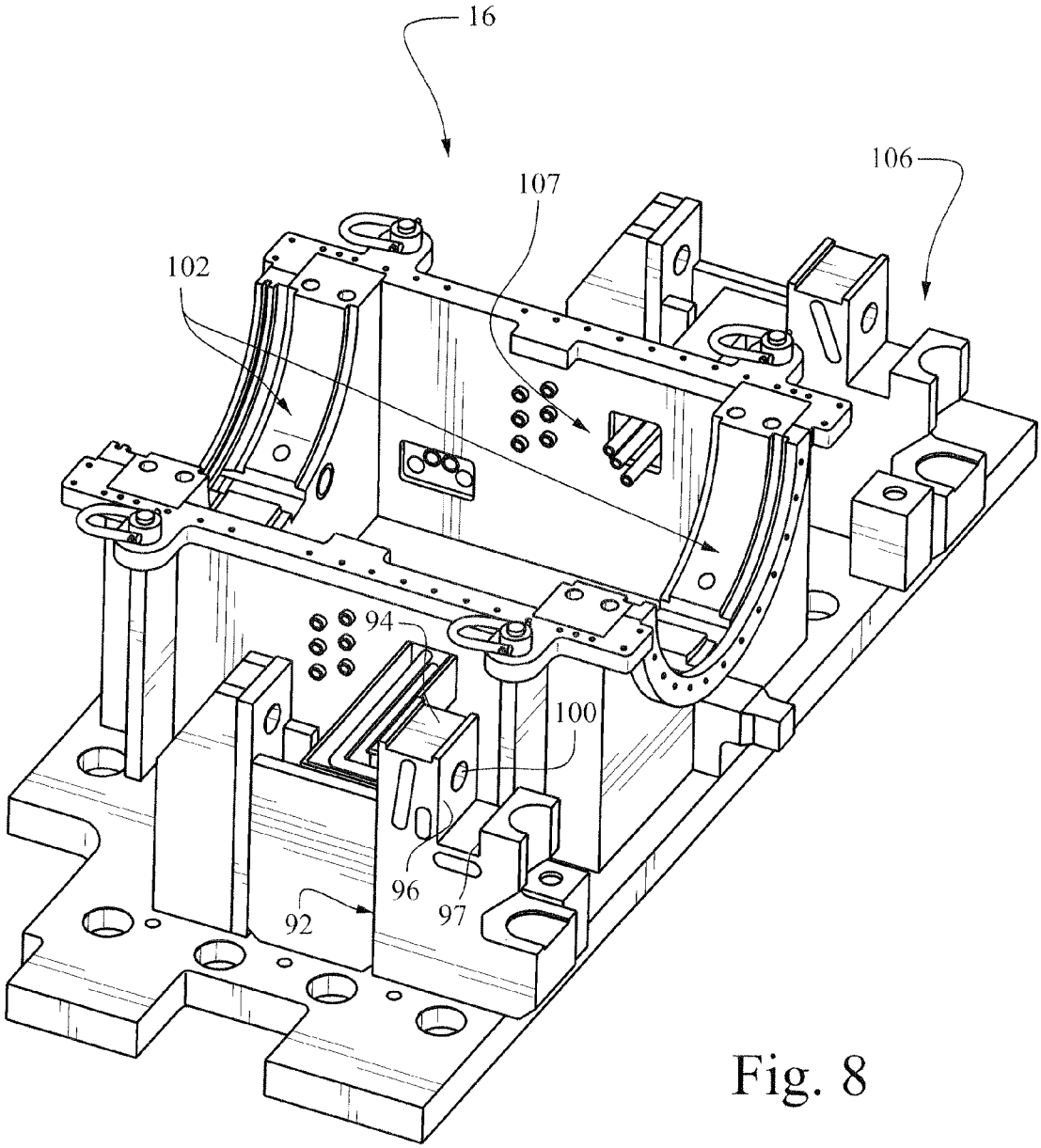
FIG. 8 is a perspective view of the LPA standard taken from FIG. 1.

Referring now to FIGS. 8 and 9, a similar cooling circuit is employed for the LPA (turbine standard adjacent to Low Pressure Hood "A") or mid-standard 16. Referencing the shell-arm support block 92, there is an overall similarity in the construction of the block as compared to the front standard 14 in that the shell-arm support block 92 includes a vertical-load key support surface 94 and an axial-load surface 96. (Note the LPA standard 16 as shown in FIG. 9 is reversed relative to the installed orientation shown in FIG. 1). In addition, a vertical load key (similar to key 34 in FIG. 3) is not shown in FIG. 9 but would typically be installed on the vertical load surface 94. The shell-arm (not shown in FIGS. 8 and 9 but identified as 98 in FIG. 1) is supported on the vertical-load surface 94. (It should be noted that upper half shell arm adjacent to mid standard 16, and depicted as 98 in FIG. 1, is an integral part of upper HP shell 36, also in FIG. 1.) The internal cooling circuit shown in FIG. 9 is similar to that shown in FIG. 7 but in this case, the circuit is routed so as to avoid an axial jacking hole 100 that passes through the support block 92.

More specifically, pressurized lubrication oil (or other suitable lubricant/heat exchange medium such as steam or water) is supplied to the LPA standard 16 and bearing blocks 102 by means of a single lubricant supply pipe (the feed line and drain lines are shown generally at 107 in FIG. 8). As in the previously-described embodiment, a predetermined faction of the inlet oil is diverted into each of the shell-arm support blocks 92, 106 and, for simplicity, the description below will be confined to the shell-arm support block 92 with the understanding that a similar circuit is found in the opposite shell-arm support block 106 as viewed in FIG. 8. Similar to FIG. 6, another shutoff valve is applied and mounted on the side wall of mid standard 16, before splitting the cooling flow to each shell support block, 92 and 106. Again, each feed pipe and drain pipe coming out of shell support block 106 is equipped with an orifice and thermocouple, similar to those shown in FIG. 6 (at 97, 95, respectively). With specific reference to FIG. 9, oil from the inlet pipe is diverted to the shell-arm support 92 via an inlet pipe 108 and enters an angled passage 110 formed in a grooved plug 112 which, in turn, supplies the oil via a lateral passage 114 to a second, angled grooved plug 116 and to a lateral passage 118 arranged above the axial jacking hole 100 and adjacent to the support surface 94. The oil then flows through a third grooved plug 120 which carries the oil to a lateral passage 122 extending along adjacent the vertical support surface 96, below the jacking hole 100. The oil then flows through a vertically-oriented grooved plug 124 to another lateral passage 126, also extending along the surface 96 and then exits via pipe 128 which connects to one of the two support block drains. At the same time, another predetermined fraction of the oil flowing through the inlet pipe 108 flows through the first-grooved plug 112 and is directed laterally via passage 130 into a fourth horizontally-oriented grooved plug 132 which then flows the oil directly underneath the horizontal surface 134 via passage 136. The oil in this part of the circuit then exits via pipe 138 and connects to the second of the two support drains. In this way, the critical surfaces of the shell-arm support block are maintained at the desired temperature, and the support block thermal growth characteristics (particularly in the vertical direction) are more closely aligned with those of the bearing blocks, 102. Note that pipe plugs, 113, 117, 119 125, 127 133 and 135 are also installed in grooved plugs 112, 116, 124 and 132, to provide inspection and cleanup access to the internal passageways connecting to these grooved plugs, such as 122, 118 and 130.

In one example, the oil is initially heated to about 110° F. e.g., and supplied on start-up to the "cold" bearing block and support arms. This allows the bearing block and support arms to heat up in a substantially-uniform manner. As the turbine reaches steady-state conditions, the lubricating oil cools the bearing block and shell support arm blocks. Using the common heat exchange medium to cool the shell-arm support blocks can reduce the typical 25-30 mil-vertical growth of the shell-arm support blocks to about 10 mils and thus more closely approximate the vertical growth of the turbine rotor.

Figure 10:
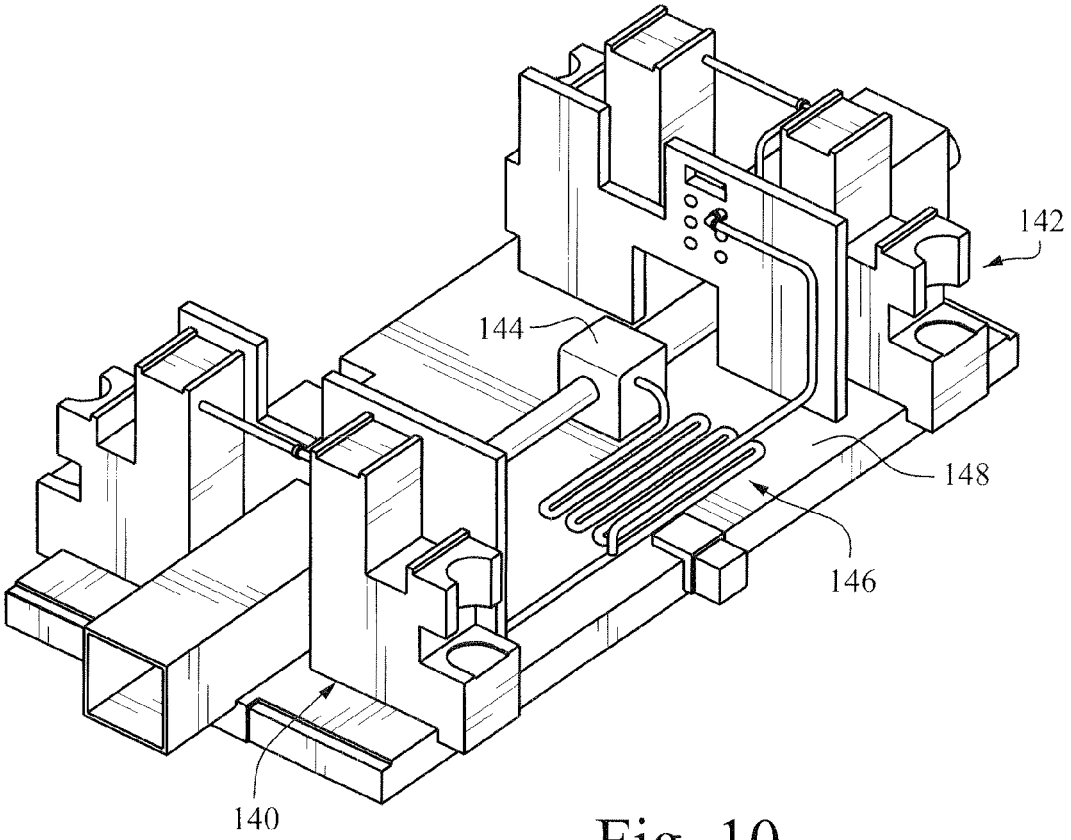
FIG. 10 is perspective view of a standard and two shell-arm support blocks cooled by a circuit in accordance with another exemplary but nonlimiting embodiment.

FIG. 10 shows a simplified schematic of a third exemplary but nonlimiting embodiment where the oil flow to the shell-arm support blocks 140, 142 is preheated by routing the oil, diverted from an inlet junction (or manifold block) 144 through a heat exchanger 146 located along the floor 148 of the block, so that the oil can absorb heat from the several inches of drain oil on the floor of the support block. This is particularly useful in start-up so that the bearing block and support blocks can be heated quickly to the desired operating temperature more quickly. At that time, the oil can be routed directly for cooling purposes, bypassing the heat exchanger 146.

By simultaneously cooling the turbine rotor bearing block and the shell-arm support blocks, the differential thermal, vertical growth is minimized, and the time differential mentioned above relating to growth and contraction times of the turbine rotor and the shell or casing support arms is substantially neutralized, so that closer radial tolerances can be obtained between the rotor and the shell. It will also be appreciated that the temperature of the heat exchange medium may be monitored using, for example, thermocouples in the drains with integrated alarms to set alert operators to an overheated condition. In addition, manual or automatic controls may be used to add or reduce the supply of heat exchange medium/lubricant to some or all of the components in any one or more of the various standards.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A standard for supporting a turbine rotor and a turbine shell comprising:

a bearing block including a housing enclosing bearing surfaces engageable by the turbine rotor;

turbine shell-arm supports on opposite sides of said housing, said turbine shell-arm supports each having a horizontal and one or more vertical surfaces adapted to be engaged by support arms of a turbine shell enclosing at least a portion of the turbine; and a cooling/heating circuit utilizing a heat exchange medium arranged to simultaneously cool or heat the bearing block and the turbine shell-arm supports to thereby reduce differential thermal growth characteristics of the turbine rotor and turbine shell.

2. The standard of claim 1 wherein said cooling/heating circuit includes an inlet line to the standard, at least one supply line to the bearing block, and at least two branch lines for diverting a fraction of flow in said standard and said at least one supply line to each of the turbine shell-arm supports.

3. The standard of claim 2 wherein each of said at least two branch lines connects to an internal circuit in each of said shell-arm supports, said internal circuit arranged to cool or heat said horizontal and said one or more vertical surfaces.

4. The standard of claim 3 wherein said internal circuit is subdivided into a first subcircuit that cools or heats said horizontal surface and a second subcircuit that cools or heats said one or more vertical surfaces, said first and second subcircuits having separate drain lines.

5. The standard of claim 4 wherein said first subcircuit includes a passage directly underlying said horizontal surface.

6. The standard of claim 4 wherein said second subcircuit includes a passage directly behind said one or more vertical surfaces.

7. The standard of claim 6 wherein said first subcircuit includes a passage directly underlying said horizontal surface.

8. The standard of claim 1 wherein said cooling/heating circuit is comprised of one or more grooved plugs inserted within each of said turbine shell-arm supports.

9. The standard of claim 1 wherein the heat exchange medium comprises steam, water or oil.

10. A standard for supporting a turbine rotor and a turbine shell comprising:

a bearing block including a housing enclosing arcuate bearing surfaces engageable by the turbine rotor;

turbine shell-arm supports on opposite sides of said housing, said turbine shell-arm supports each having a horizontal and one or more vertical surfaces adapted to be engaged by support arms of a turbine shell enclosing at least a portion of the turbine;

a cooling/heating circuit arranged to supply a liquid to simultaneously cool or heat the bearing block and the turbine shell-arm support blocks to thereby reduce differential thermal growth characteristics of the turbine rotor and turbine shell; and wherein said at least two branch lines connect to an internal circuit in each of said shell-arm supports, said internal circuit arranged to cool or heat said horizontal and said one or more vertical surfaces.

11. The standard of claim 10 including an optional heat exchanger where the liquid passes in heat exchange relationship with warmer liquid to thereby heat the bearing block and turbine area shell support blocks.

12. The standard of claim 10 wherein said internal circuit is subdivided into a first subcircuit that cools or heats said horizontal surface and a second subcircuit that cools or heats said one or more vertical surfaces, said first and second subcircuits having separate drain lines.

13. The standard of claim 12 wherein said first subcircuit includes a passage directly underlying said horizontal surface.

14. The standard of claim 12 wherein said second subcircuit includes a passage directly behind said one or more vertical surfaces.

15. The standard of claim 12 wherein said first subcircuit includes a passage directly underlying said horizontal surface.

16. The standard of claim 10 including a manual shut-off device for stopping flow to said heating/cooling circuit.

17. The standard of claim 10 wherein said circuit includes feed and drain lines, and wherein each feed and drain line incorporates a monitoring thermocouple.

18. The standard of claim 17 wherein each feed and drain line incorporates a flow orifice.

19. The standard of claim 1 wherein said circuit includes feed and drain lines, and wherein each feed and drain line incorporates a monitoring thermocouple.

20. The standard of claim 19 wherein each feed and drain line incorporates a flow orifice.

* * * * *